US012389998B2

(12) United States Patent
Chang

(10) Patent No.: US 12,389,998 B2
(45) Date of Patent: Aug. 19, 2025

(54) COSMETIC CONTAINER AND METHOD FOR USING THE SAME

(71) Applicant: Ta-peng Chang, New Taipei (CN)

(72) Inventor: Ta-peng Chang, New Taipei (CN)

( * ) Notice: Subject to any disclaimer, the term of this patent is extended or adjusted under 35 U.S.C. 154(b) by 383 days.

(21) Appl. No.: 17/995,935

(22) PCT Filed: Apr. 20, 2021

(86) PCT No.: PCT/CN2021/088259

§ 371 (c)(1),
(2) Date: Oct. 11, 2022

(87) PCT Pub. No.: WO2021/213350

PCT Pub. Date: Oct. 28, 2021

(65) Prior Publication Data

US 2023/0210242 A1 Jul. 6, 2023

(30) Foreign Application Priority Data

Apr. 21, 2020 (CN) ..... 202010316636.2

(51) Int. Cl.
*A45D 40/04* (2006.01)
*A45D 40/14* (2006.01)

(52) U.S. Cl.
CPC ..... *A45D 40/04* (2013.01); *A45D 40/14* (2013.01)

(58) Field of Classification Search
CPC ..... A45D 40/04; A45D 40/00; A45D 40/02; A45D 40/06; A45D 40/14; A45D 40/20; A45D 40/205; A45D 2040/208
(Continued)

(56) References Cited

U.S. PATENT DOCUMENTS 2,429,328 A 10/1947 Andre
2,895,607 A * 7/1959 Dulberg ..... A45D 40/14 401/63

(Continued)

FOREIGN PATENT DOCUMENTS

CN 106466047 A 3/2017
CN 107510217 A 12/2017

(Continued)

OTHER PUBLICATIONS

English Translation of Notice for Reasons for Refusal for Japanese Patent Application No. 2022-564296 dated Nov. 24, 2023.

(Continued)

*Primary Examiner* — David J Walczak
(74) *Attorney, Agent, or Firm* — Fox Rothschild LLP

(57) ABSTRACT

A cosmetic container and a method for using the same. The cosmetic container includes: a threaded sleeve with an inner wall having a first guide groove and a second guide groove; a rotating member rotatably sleeved in the threaded sleeve, with a side wall having a slideway pattern; a material cup slidably sleeved in the rotating member, with a side wall having a third slideway and at least one first lug passing through the slideway pattern and limited in the first guide groove; and a pushing cup slidably sleeved in the material cup, with a side wall having at least one second lug passing successively through the third slideway and the slideway pattern and limited in the second guide groove. The cosmetic container enables a material body contained in it to be used up and is easy to operate.

6 Claims, 11 Drawing Sheets

(58) Field of Classification Search
USPC ..... 401/75–78, 171–174
See application file for complete search history.

(56) References Cited

U.S. PATENT DOCUMENTS

| | | | | |
|---|---|---|---|---|
| 4,616,947 | A | 10/1986 | Iwamoto et al. | |
| 4,991,987 | A | 2/1991 | Holloway et al. | |
| 5,746,530 | A | 5/1998 | Oota | |
| 5,842,804 | A | 12/1998 | Hurlburt | |
| 11,779,095 | B2 * | 10/2023 | Byeon | A45D 40/06 401/108 |
| 2005/0277300 | A1 | 12/2005 | Efferenn et al. | |
| 2008/0277300 | A1 | 11/2008 | Kang | |

FOREIGN PATENT DOCUMENTS

| | | | |
|---|---|---|---|
| CN | 111449404 | A | 7/2020 |
| CN | 211984252 | U | 11/2020 |
| EP | 0799589 | A2 | 10/1997 |
| JP | 59095916 | U | 6/1984 |
| JP | 62136916 | U | 8/1987 |
| JP | H07303519 | A | 11/1995 |
| JP | H08173240 | A | 7/1996 |

OTHER PUBLICATIONS

Extended Search Report for European Patent Application No. 21793610.3.dated Dec. 1, 2013.

English Translation of Notice of Allowance for Jpanaese Patent Application No. 2022-564296 dated May 21, 2024.

First Office Action issued on Jan. 30, 2022 for Chinese Patent Application No. 202010316636.2 (11 pages).

International Search Report issued on Jun. 30, 2021 for International Patent Application No. PCT/CN2021/088259 (4 pages).

* cited by examiner

COSMETIC CONTAINER AND METHOD FOR USING THE SAME

CROSS-REFERENCE TO RELATED APPLICATIONS

This Application is based upon PCT patent application No. PCT/CN2021/088259 filed on Apr. 20, 2021, which claims priority to Chinese Patent Application No. 202010316636.2 filed on Apr. 21, 2020, the entire contents of which are incorporated herein by reference.

TECHNICAL FIELD

The present disclosure relates to the field of cosmetic packaging, in particular to a cosmetic container and a method for using the same.

BACKGROUND

In traditional cosmetic containers, such as lipstick tubes, lipstick boxes, etc., a material body is placed in a cup body, and when the cup body is ascended and descended, the material body is driven to move out and back.

Since the material body is placed in the cup body, even if the cup body is completely ascended, part of the material body placed in the cup body cannot be used up, resulting in waste. According to statistics, in the traditional cosmetic containers, usually 35% of the material body is placed in the cup body, resulting in a failure to improve a utilization rate of the material body.

If most of the material body sticks out of the cup body, leaving a small part placed in the cup body, the material body needs to be made of a harder material, which reduces a user experience. In addition, most of the material body sticking out of the cup body also easily causes the material body to be broken, which affects the user experience.

Therefore, the utilization rate, the user experience and a service life of the material body cannot be balanced.

SUMMARY

The present disclosure provides a cosmetic container and a method for using the same, which can improve a utilization rate of a material body in the cosmetic container and meanwhile improves a user experience and a service life of the material body.

An aspect of the present disclosure provides a cosmetic container, including: a threaded sleeve, wherein an inner wall of the threaded sleeve is provided with a first guide groove and a second guide groove forming a double helix; a rotating member, rotatably sleeved in the threaded sleeve, wherein a side wall of the rotating member is provided with a hollowed-out slideway pattern, and the slideway pattern includes at least a first slideway and a second slideway both extending axially and connected with each other; a material cup, slidably sleeved in the rotating member, wherein a side wall of the material cup protrudes outwardly to form at least one first lug, the first lug passes through the slideway pattern and is limited in the first guide groove, and the side wall of the material cup is provided with a third slideway extending axially; and a pushing cup, slidably sleeved in the material cup, wherein a side wall of the pushing cup protrudes outwardly to form at least one second lug, the second lug passes successively through the third slideway and the slideway pattern and is limited in the second guide groove.

In some embodiments, in the cosmetic container, when the rotating member is rotated relative to the threaded sleeve, the third slideway is successively overlapped with the first slideway and the second slideway, forming a first combined slideway for the pushing cup and the material cup to ascend and descend synchronously and a second combined slideway only for the pushing cup to ascend and descend.

In some embodiments, in the cosmetic container, the first lug and the third slideway are arranged in a same axis; the first combined slideway includes: the third slideway and a part of the first slideway that are overlapped with each other for the pushing cup to ascend and descend, and another part of the first slideway for the material cup to ascend and descend; the second combined slideway includes the third slideway and the second slideway that are overlapped with each other.

In some embodiments, in the cosmetic container, the first slideway is provided with a material cup upper locking position for preventing the material cup from ascending.

In some embodiments, in the cosmetic container, the first slideway is provided with a material cup lower locking position for preventing the material cup from descending and a pushing cup lower locking position for preventing the pushing cup from descending.

In some embodiments, in the cosmetic container, the rotating member includes a cylinder part sleeved in the threaded sleeve and an actuating part extending out of the threaded sleeve, the slideway pattern is hollowed out on a side wall of the cylinder part; and an end surface of the cylinder part connected with the actuating part is provided with first convex ribs for preventing the material cup from descending.

In some embodiments, in the cosmetic container, a lower end surface of the material cup is provided with second convex ribs for preventing the pushing cup from descending.

In some embodiments, in the cosmetic container, an inner wall of the material cup is provided with ribs extending axially, an outer wall of the pushing cup is provided with grooves extending axially, and the ribs are axially slidably limited in the grooves.

Another aspect of the present disclosure provides a method for using a cosmetic container, based on the above-mentioned cosmetic containers, wherein the method includes a first stroke of driving the material cup and the pushing cup to ascend and descend synchronously and a second stroke of only driving the pushing cup to ascend and descend; the first stroke includes a first ascending stroke and a first descending stroke, the second stroke includes a second ascending stroke and a second descending stroke, the first ascending stroke and the second ascending stroke are performed sequentially, and the second descending stroke and the first descending stroke are performed sequentially.

In some embodiments, in the method, the first ascending stroke includes: rotating the rotating member in a positive direction to drive the material cup and the pushing cup to ascend synchronously along the first combined slideway; the second ascending stroke includes: rotating the rotating member in the positive direction to drive the pushing cup to ascend along the second combined slideway; the second descending stroke includes: rotating the rotating member in a negative direction to drive the pushing cup to descend along the second combined slideway; the first descending stroke includes: rotating the rotating member in the negative direction to drive the material cup and the pushing cup to descend synchronously along the first combined slideway.

Compared with the prior art, the present disclosure includes at least the following advantages.

Due to the rotatable material cup and pushing cup, the cosmetic container has at least two strokes. During the first stroke, the material cup and the pushing cup can be ascended and descended synchronously. During the second stroke, the pushing cup can be ascended and descended relative to the material body, so that the material body placed in the material cup can be completely used up, which improves the utilization rate of the material body. In addition, most of the material body can be placed in the material cup to avoid breaking, and soft materials can be flexibly selected to improve the user experience.

The rotating member provides a sliding space for the material cup and the pushing cup; by sharing the slideway pattern between the material cup and the pushing cup, an area of the slideway pattern can be reduced to ensure firmness of the rotating member. Furthermore, with the third slideway extending axially, on the one hand, the material cup and the pushing cup can move in a same direction, and on the other hand, the third slideway can be overlapped with the first slideway and the second slideway of the slideway pattern, respectively, forming the first combined slideway for the material cup and the pushing cup to ascend and descend synchronously and the second combined slideway only for the pushing cup to ascend and descend, which is easy to operate.

It should be understood that the above general description and the following detailed description are only exemplary and explanatory and cannot limit the present disclosure.

BRIEF DESCRIPTION OF THE DRAWINGS

By reading the detailed description of non-limiting embodiments with reference to the following drawings, other features, objects and advantages of the present disclosure will be more obvious.

DETAILED DESCRIPTION

Figure 1:
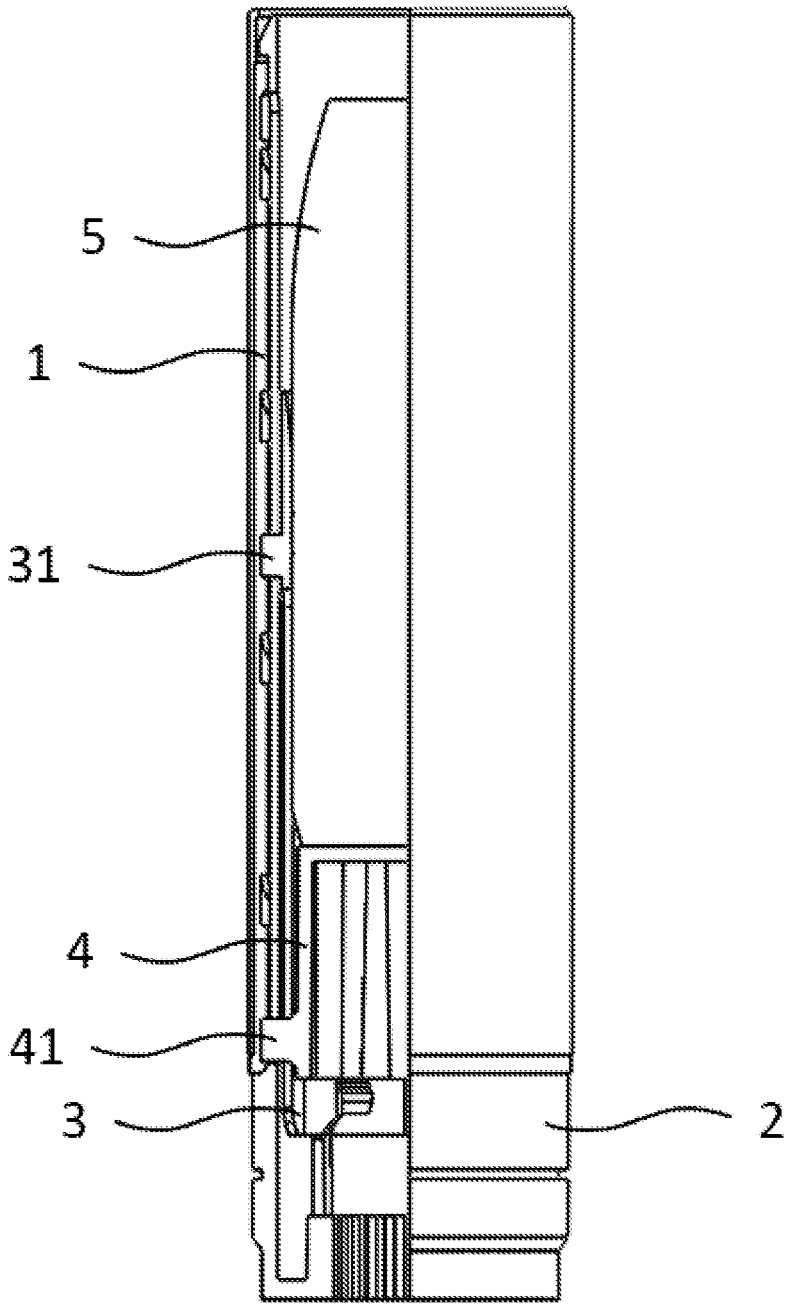
FIG. 1 is a schematic view of a cosmetic container in an embodiment of the present disclosure.

Example embodiments will now be fully described with reference to the accompanying drawings. However, the example embodiments can be implemented in various forms and should not be construed as limited to the embodiments described here; rather, these embodiments are provided to make the present disclosure comprehensive and complete, and to transmit the conception of the example embodiments comprehensively to those skilled in the art. The same reference symbols in the drawings indicate the same or similar structures, so their repeated descriptions will be omitted.

A cosmetic container of the present disclosure is used for containing paste materials, such as lipstick, lip balm, etc. The cosmetic container can also be applied to other similar fields, such as for containing solid glue, paint and the like.

Figure 2:
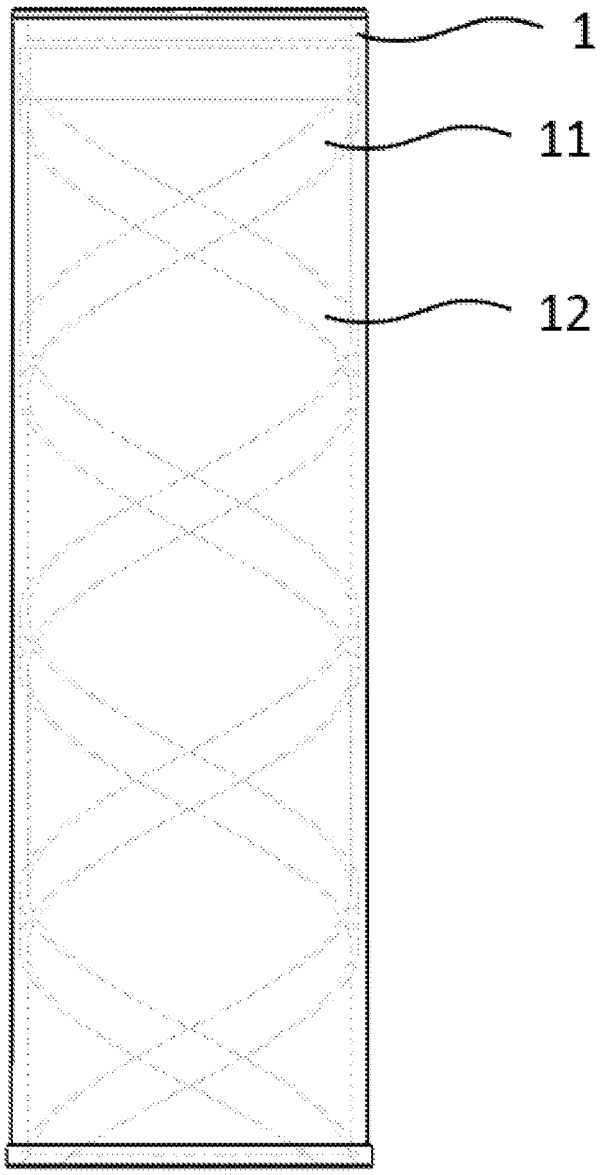
FIG. 2 is a schematic view of a threaded sleeve in an embodiment of the present disclosure.
Figure 3:
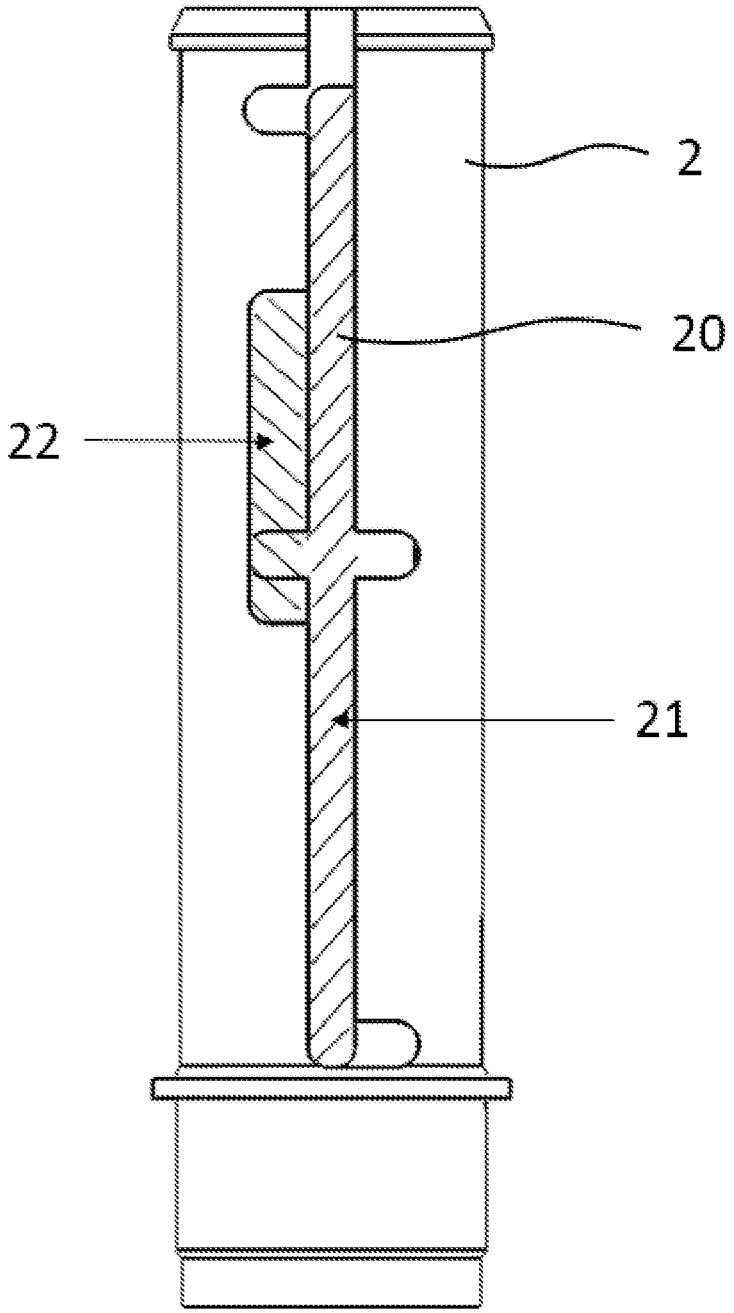
FIGS. 3 to 6 are schematic views of rotating members in embodiments of the present disclosure.
Figure 7:
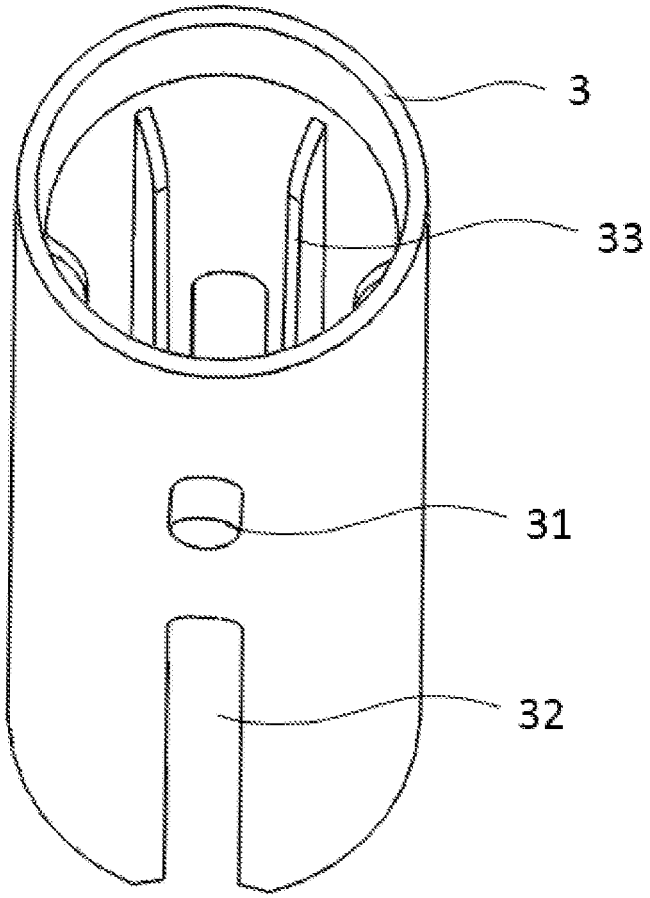
FIG. 7 is a schematic view of a material cup in an embodiment of the present disclosure.
Figure 8:
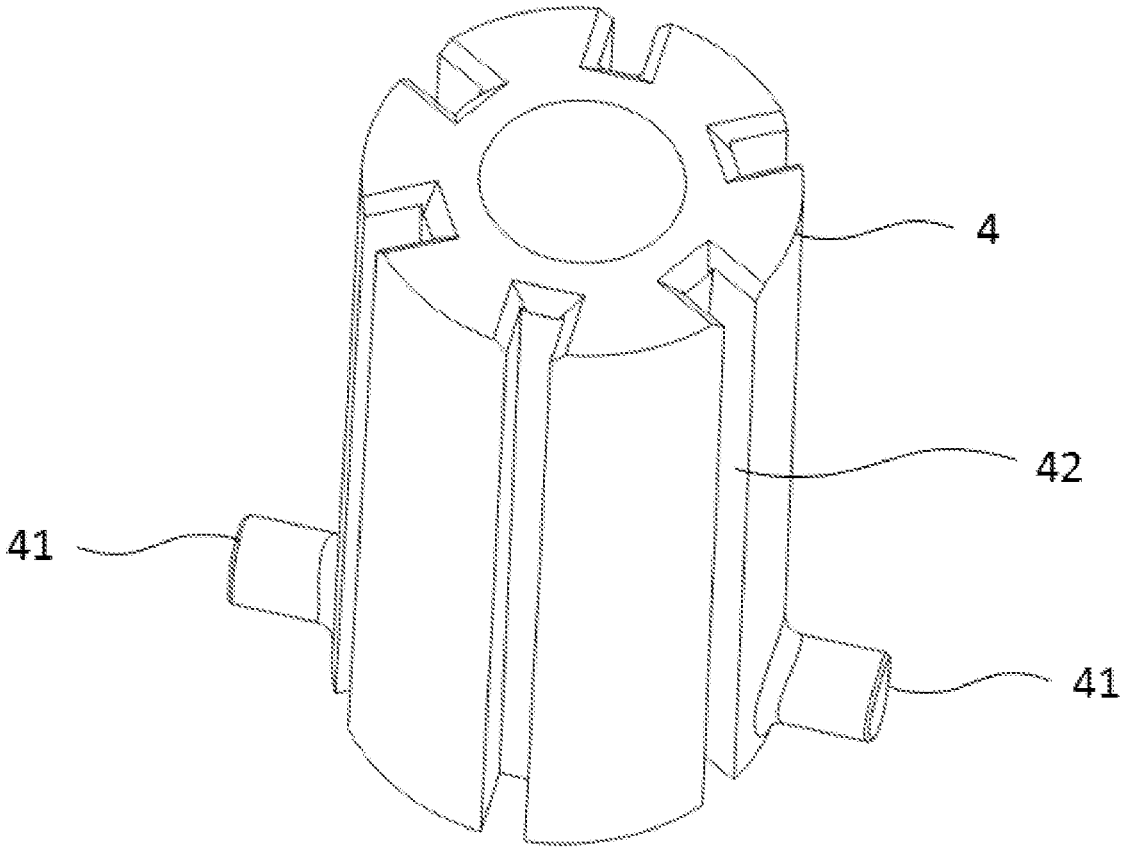
FIG. 8 is a schematic view of a pushing cup in an embodiment of the present disclosure.
Figure 9:
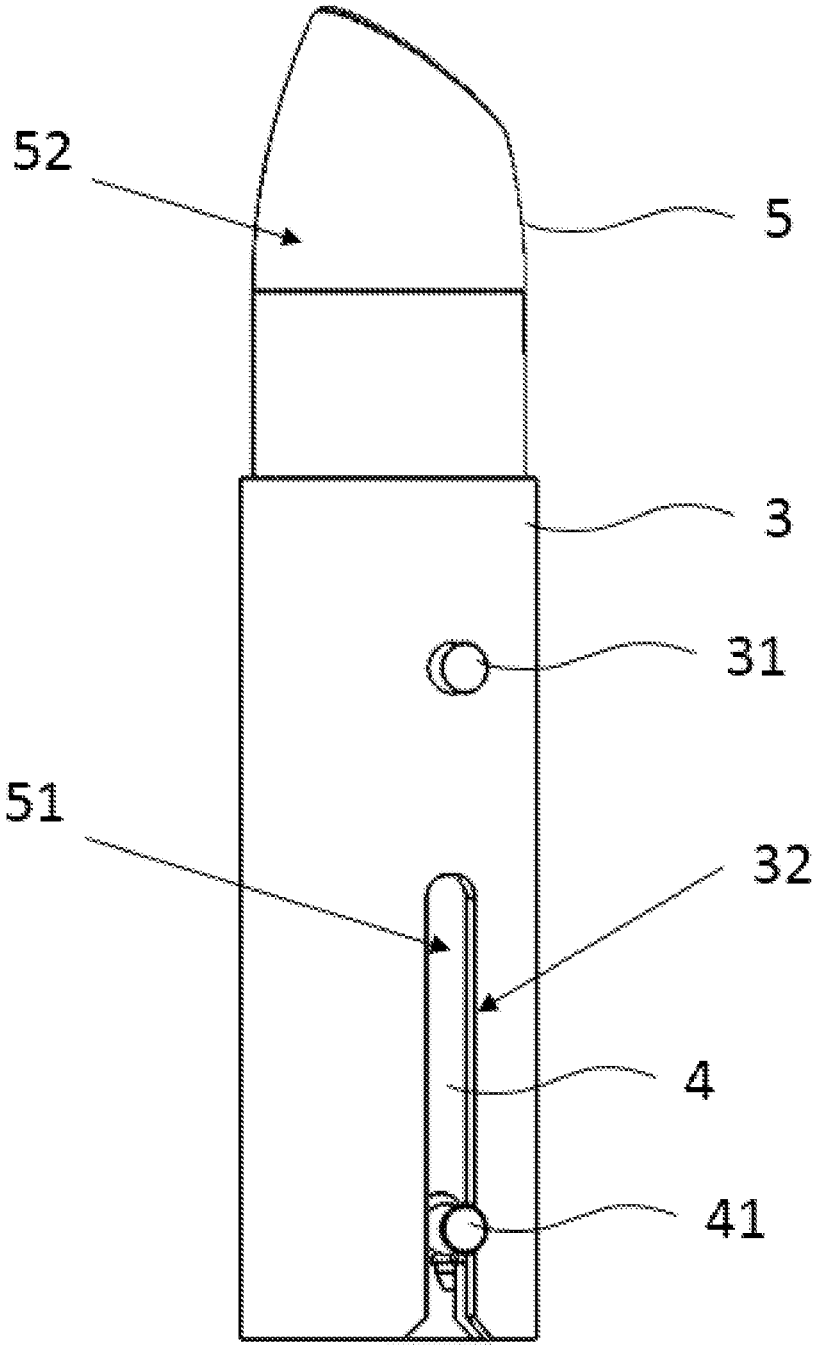
FIG. 9 is a schematic view of an assembly structure of the material cup, the pushing cup and a material body in an embodiment of the present disclosure.

FIG. 1 shows a cosmetic container in an embodiment, FIG. 2 shows a structure of a threaded sleeve, FIG. 3 shows a structure of a rotating member, FIG. 7 shows a structure of a material cup, FIG. 8 shows a structure of a pushing cup, FIG. 9 shows an assembly structure of the material cup, the pushing cup and a material body. Referring to FIGS. 1 to 3 and 7 to 9, the cosmetic container in the embodiment includes the following components.

A threaded sleeve 1, wherein an inner wall thereof is provided with a first guide groove 11 and a second guide groove 12 forming a double helix. FIG. 2 only schematically shows the first guide groove 11 and the second guide groove 12; in practical applications, the first guide groove 11 and the second guide groove 12 can be interchanged, as long as the double helix is formed.

A rotating member 2 rotatably sleeved in the threaded sleeve 1, wherein a side wall of the rotating member 2 is provided with a hollowed-out slideway pattern 20. The slideway pattern 20 includes at least a first slideway 21 and a second slideway 22 both extending axially and connected with each other. In FIG. 3, the first slideway 21 and the second slideway 22 are respectively marked by two sections which extend axially and are filled with diagonal lines.

A material cup 3 slidably sleeved in the rotating member 2, wherein a side wall of the material cup 3 protrudes outwardly to form at least one first lug 31. The first lug 31 passes through the slideway pattern 20 and is limited in the first guide groove 11. The side wall of the material cup 3 is further provided with a third slideway 32 extending axially. In the embodiment, a pair of first lugs 31 and a pair of third slideway 32 can be symmetrically arranged on the side wall of the material cup 3.

A pushing cup 4 slidably sleeved in the material cup 3, wherein a side wall of the pushing cup 4 protrudes outwardly to form at least one second lug 41. The second lug 41 passes successively through the third slideway 32 and the slideway pattern 20 and is limited in the second guide groove 12. FIG. 8 shows that the side wall of the pushing cup 4 is symmetrically provided with two second lugs 41, and each second lug 41 correspondingly passes through one of the third slideway 32.

A material body 5 contained in the material cup 3 and supported by the pushing cup 4, and the material body 5 has a first part 51 placed in the material cup 3 and a second part 52 extending out of the material cup 3.

The cosmetic container of the embodiment has at least two strokes, including a first stroke during which the material cup 3 and the pushing cup 4 are ascended and descended synchronously and a second stroke during which only the pushing cup 4 is ascended and descended. During the first stroke, with a rotation of the rotating member 2 relative to the threaded sleeve 1, the first guide groove 11 guides the first lugs 31 of the material cup 3 to ascend and descend along the slideway pattern 20, and the second guide groove 12 guides the second lugs 42 of the pushing cup 4 to ascend and descend along the slideway pattern 20. At this time, the material body 5 is ascended and descended along with the material cup 3 and the pushing cup 4, and the second part 52 of the material body 5 can be extended out of the rotating member 2 for use and returned back to the rotating member 2 for storage. When the material cup 3 is ascended to a certain level (for example, an upper end surface of the material cup 3 is ascended to be flush with or slightly higher than an upper end surface of the rotating part 2), the first stroke ends, and the second stroke starts. During the second stroke, the pushing cup 4 is ascended and descended relative to the material cup 3, and the pushing cup 4 drives the first part 51 of the material body 5 placed in the material cup 3 to extend out of and return back to the material cup 3. The third slideway 32 extending axially keeps the material cup 3 and the pushing cup 4 moving in a same direction during the first stroke and makes the pushing cup 4 move axially relative to the material cup 3 during the second stroke.

Under a combined action of the material cup 3 and the pushing cup 4, firstly, the material body 5 can be completely extended out of the material cup 3, so that the material body 5 can be used up and a utilization rate can be improved; secondly, most of the material body 5 can be placed in the material cup 3, for example, the first part 51 can occupy for about 70% of an overall length of the material body 5, so as to avoid breaking and prolong a service life of the material body 5; thirdly, since most of the material body 5 is placed in the material cup 3, the material body 5 can be made of softer materials to improve a user experience. In addition, a height of the material cup 3 can be increased. A height of a traditional material cup accounts for about 30% of an overall height of a tube body, to avoid too much material being wasted in the material cup. Using the cosmetic container of the present disclosure, the material body 5 can be completely extended out, so that the height of the material cup 3 can be greatly increased, for example accounting for 50%~90% of a height of the rotating member 2, thereby 50%~90% of the material body 5 can be placed in the material cup 3. Of course, in actual productions, the specific height of the material cup 3 can be flexibly determined as required.

In a specific embodiment, referring to the rotating member shown in FIG. 3 and the material cup shown in FIG. 7, when the rotating member 2 is rotated relative to the threaded sleeve 1, each third slideway 32 is successively overlapped with the first slideway 21 and the second slideway 22, forming a first combined slideway for the pushing cup 4 and the material cup 3 to ascend and descend synchronously and a second combined slideway only for the pushing cup 4 to ascend and descend.

Figure 4:
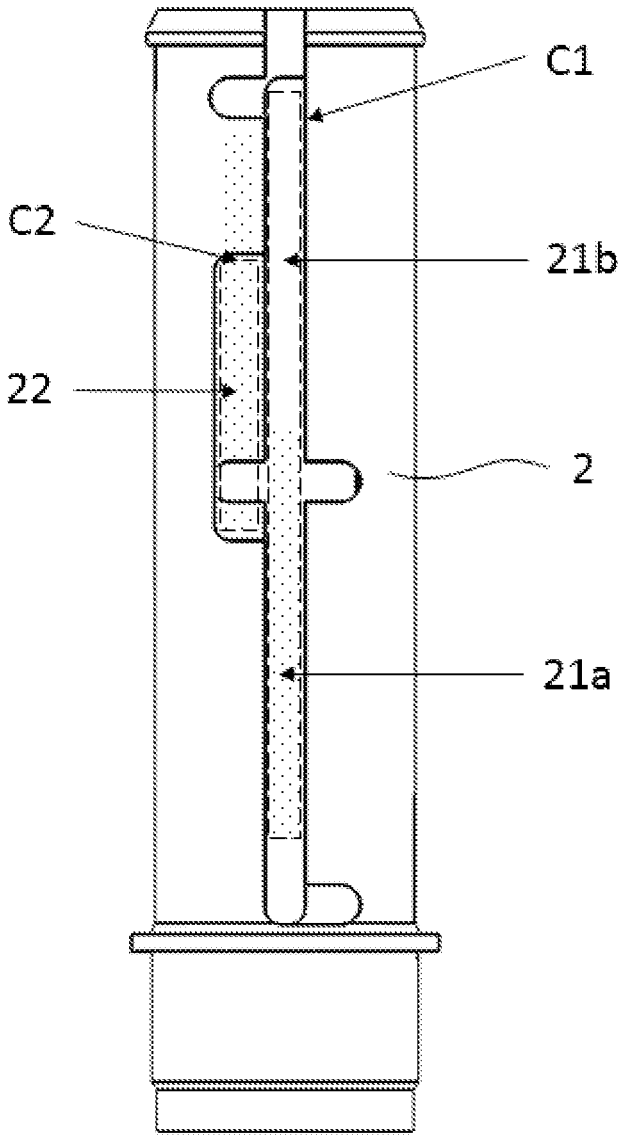

In a further embodiment, the first lug 31 and the third slideway 32 on a same side are arranged in a same axis. In the present disclosure, since both the rotatable material cup 3 and the rotatable pushing cup 4 are sleeved in the rotating member 2, the slideway pattern 20 hollowed out on the rotating member 2 is correspondingly increased. In the embodiment, by arranging the first lug 31 and the third slideway 32 in the same axis (for example, the first lug 31 is arranged above the third slideway 32), on the one hand, it can facilitate an alignment during molding to improve accuracy, on the other hand, the first lugs 31 and the second lugs 41 can share part of the slideway pattern 20, thereby reducing an area of the slideway pattern 20 hollowed out on the rotating member 2, to improve firmness of the rotating member 2. For example, the first lugs 31 and the second lugs 41 share the first slideway 21 of the slideway pattern 20. Referring to FIG. 4, a dotted box C1 is used to indicate the first combined slideway, a dotted box C2 is used to indicate the second combined slideway, and a shaded area filled with dots is used to indicate the third slideway. The first combined slideway C1 includes the third slideway and a part 21*a* of the first slideway (i.e., a shaded area filled with dots in the dotted box C1) overlapped with each other for the pushing cup 4 to ascend and descend, and another part 21*b* of the first slideway (i.e., a blank area in the dotted box C1) for the material cup 3 to ascend and descend. The second combined slideway C2 includes the third slideway and the second slideway 22 overlapped with each other for the pushing cup 4 to ascend and descend. During ascending and descending processes of the material cup 3, overlapping areas of the third slideway and the first slideway will be changed accordingly.

Furthermore, the first slideway 21 can be provided with material cup upper locking positions to lock the material cup 3 when the material cup 3 is ascended to a certain level, thereby making the pushing cup 4 ascend and descend relative to the material cup 3. Referring to the above-mentioned embodiment in which the first lug 31 is coaxially arranged above the third slideway 32 and to the rotating member shown in FIG. 5, an upper end of the first slideway 21 is provided with the material cup upper locking positions 302 for locking the material cup 3. Under an action of the material cup upper locking positions 302, when the material cup 3 and the pushing cup 4 are synchronously ascended to the first lugs 31 of the material cup 3 reach the material cup upper locking positions 302, the material cup 3 is locked and cannot continue to ascend. At this time, following the material cup 3, the pushing cup 4 reaches a connected area 4012 between the first slideway 21 and the second slideway 22. Subsequently, the material cup 3 is locked in the material cup upper locking positions 302, and the pushing cup 4 can be ascended and descended along the second slideway 22, relative to the material cup 3.

Figure 5:
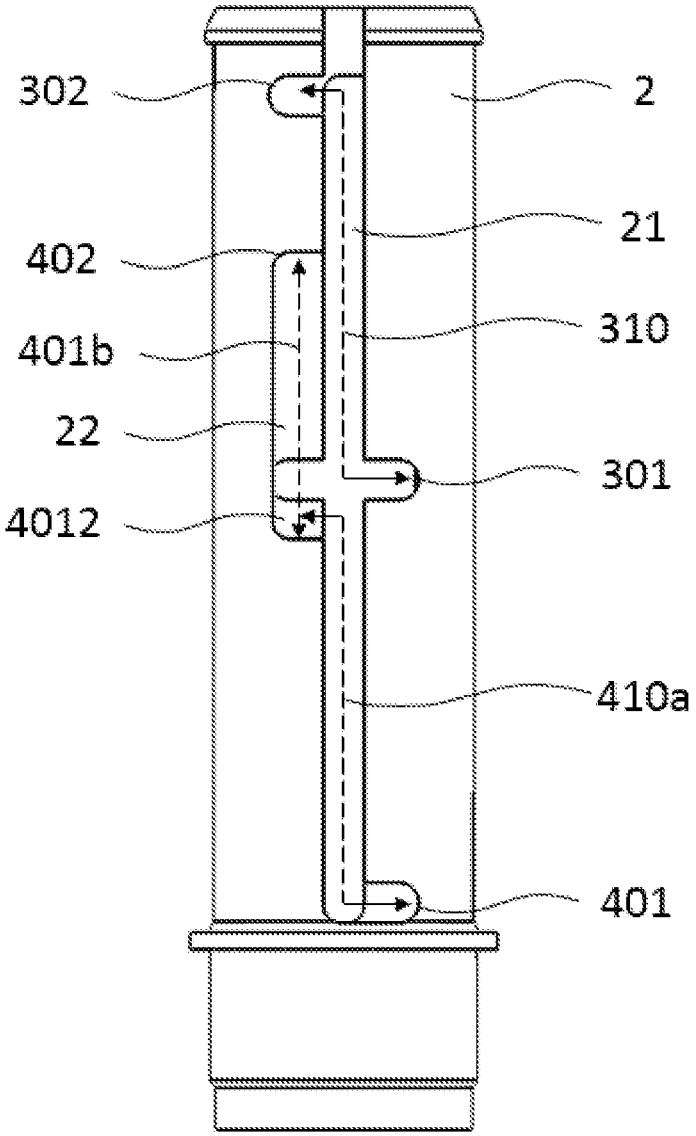

Furthermore, the first slideway 21 is further provided with material cup lower locking positions 301 for preventing the material cup 3 from descending and pushing cup lower locking positions 401 for preventing the pushing cup 4 from descending, respectively. Under an action of the material cup lower locking positions 301, when the material cup 3 is descended to the first lugs 31 thereof reaching the material cup lower locking positions 301, the material cup 3 is locked and cannot continue to descend. Similarly, under an action of the pushing cup lower locking positions 401, when the pushing cup 4 is descended to the second lugs 41 thereof reaching the pushing cup lower locking positions 401, the pushing cup 4 is locked and cannot continue to descend. All of the material cup lower locking positions 301, the material cup upper locking positions 302 and the pushing cup lower locking positions 401 can be extended in a circumferential direction as shown in FIG. 5. Due to locking effects of the material cup lower locking positions 301 and the pushing cup lower locking positions 401, when the cosmetic container is not in use (for example, in an idle state or a transportation state, etc.), the material cup lower locking positions 301 and the pushing cup lower locking positions 401 lock the material cup 3 and pushing cup 4 to prevent loosening, respectively. When the cosmetic container needs to be used, actuate the rotating member 2, the material cup lower locking positions 301 and the pushing cup lower locking positions 401 will be unlocked, then the first lugs 31 of the material cup 3 and the second lugs 41 of the pushing cup 4 will be pushed, respectively by the first guide groove 11 and the second guide groove 12, into the first slideway 21 to enter a use state. During the use state, the third slideway 32 extending axially keeps the pushing cup 4 and the material cup 3 moving in the same direction and further prevents the pushing cup 4 from slipping off to the material cup lower locking positions 301 when the pushing cup 4 is descended.

Specifically, as shown in FIG. 7, FIG. 8 and FIG. 5, during the first stroke, when the material cup 3 and the pushing cup 4 are ascended and descended synchronously, a sliding trajectory of the first lug 31 of the material cup 3 is shown as a bidirectional dashed arrow 310, the first lug 31 slides along the first slideway 21 between the material cup lower locking position 301 and the material cup upper locking position 302. The material cup 3 can be descended until the first lugs 31 are locked in the material cup lower locking positions 301, and the material cup 3 can be ascended until the first lugs 31 are locked in the material cup upper locking positions 302. Similarly, during the first stroke, a sliding trajectory of the second lug 41 of the pushing cup 4 is shown as a bidirectional dashed arrow 410*a*, the second lug 41 slides along the first slideway 21 between the pushing cup lower locking position 401 and the connected area 4012. When the material cup 3 is descended to the first lugs 31 locked in the material cup lower locking positions 301, the second lugs 41 of the pushing cup 4 are locked in the pushing cup lower locking positions 401; and when the material cup 3 is ascended to the first lugs 31 locked in the material cup upper locking positions 302, the second lugs 41 of the pushing cup 4 reach the connected area 4012. During the second stroke, only the pushing cup 4 is ascended and descended, the material cup 3 remains stationary since the first lugs 31 of the material cup 3 are locked in the material cup upper locking positions 302, and a sliding trajectory of the second lug 41 of the pushing cup 4 is shown as a bidirectional dashed arrow 401*b*, the second lug 41 slides along the second slideway 22 between a lower end (i.e., the connected area 4012) of the second slideway 22 and an upper end 402 of the second slideway 22.

Figure 6:
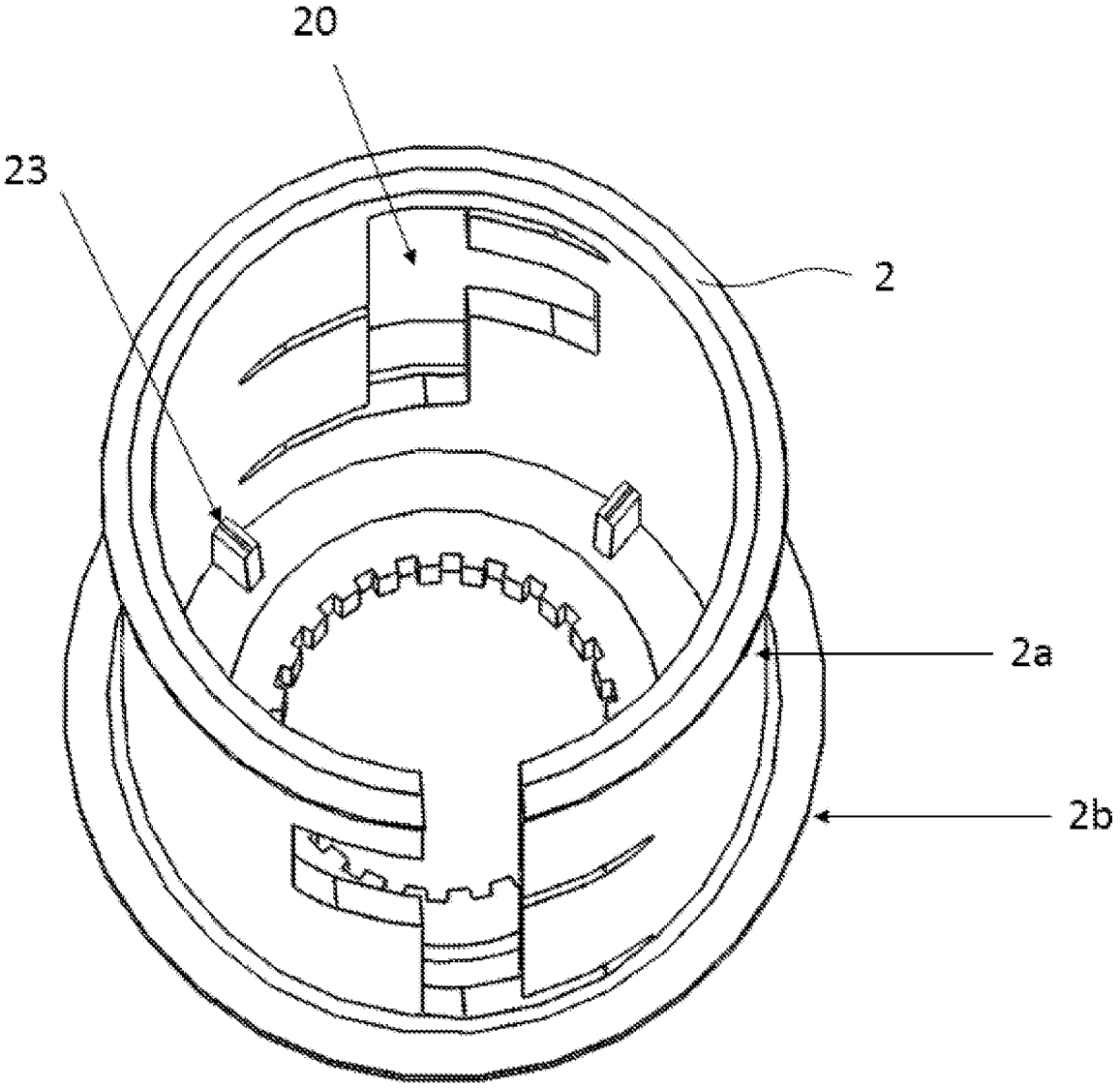

In the cosmetic container of the present disclosure, referring to FIG. 1 and the rotating member shown in FIG. 6, the rotating member 2 includes a cylinder part 2*a* sleeved in the threaded sleeve 1 and an actuating part 2*b* extending out of the threaded sleeve 1, and the slideway pattern 20 is hollowed out on a side wall of the cylinder part 2*a*. When using the cosmetic container, rotate the actuating part 2*b*, the rotating member 2 will be driven to rotate in the threaded sleeve 1, thereby the material cup 3 and/or the pushing cup 4 are driven to ascend and descend. An end surface of the cylinder part 2*a* connected to the actuating part 2*b* is provided with first convex ribs 23 for preventing the material cup 3 from descending; when the material cup 3 is descended to its lower end surface being pressed against the first convex ribs 23, its descending stops, so that the material cup 3 will not be descended unrestrictedly, thereby avoiding damage to the cosmetic container.

Furthermore, a lower end surface of the material cup 3 may be provided with second convex ribs (not shown in the drawings) for preventing the pushing cup 4 from descending. When the pushing cup 4 is descended to its lower end surface being pressed against the second convex ribs, its descending stops, so that the pushing cup 4 will not be descended unrestrictedly, thereby avoiding damage to the cosmetic container.

In a preferred embodiment, referring to the material cup shown in FIG. 7 and the pushing cup shown in FIG. 8, an inner wall of the material cup 3 is provided with ribs 33 extending axially, an outer wall of the pushing cup 4 is provided with grooves 42 extending axially, and the ribs 33 are axially slidably limited in the grooves 42. The embedded ribs 33 and grooves 42 ensure that the material cup 3 and the pushing cup 4 move in the same direction and further plays a limiting role on the pushing cup 4 to prevent the pushing cup 4 from slipping off.

Embodiments of the present disclosure also provide a method for using the above-mentioned cosmetic containers, the method includes a first stroke of driving the material cup 3 and the pushing cup 4 to ascend and descend synchronously and a second stroke of only driving the pushing cup 4 to ascend and descend. The first stroke includes a first ascending stroke and a first descending stroke. The second stroke includes a second ascending stroke and a second descending stroke. The first ascending stroke and the second ascending stroke are performed sequentially, and the second descending stroke and the first descending stroke are performed sequentially. The first ascending stroke includes: rotating the rotating member in a positive direction, driving the pushing cup and the material cup to ascend synchronously along the first combined slideway; and the second ascending stroke includes: rotating the rotating member in the positive direction, driving the pushing cup to ascend along the second combined slideway. The second descending stroke includes: rotating the rotating member in a negative direction, driving the pushing cup to descend along the second combined slideway; and the first descending stroke includes: rotating the rotating member in the negative direction, driving the material cup and the pushing cup to descend synchronously along the first combined slideway.

Figure 10:
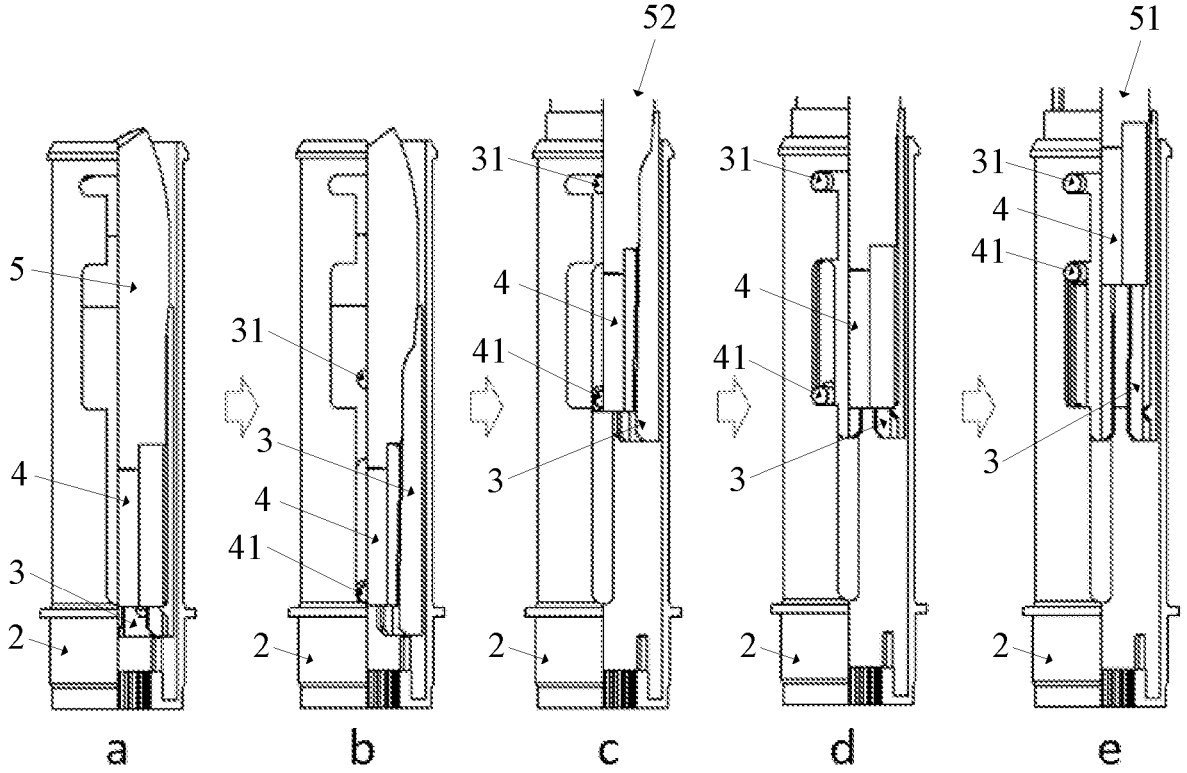
FIG. 10 is a schematic view of a positive rotation process of the cosmetic container in an embodiment of the present disclosure.

Referring to positive rotation processes of the cosmetic container shown in FIG. 10, wherein FIGS. 10*a* to 10*d* illustrate the first ascending stroke during which the material cup 3 and the pushing cup 4 are ascended synchronously along the first combined slideway, and FIGS. 10*d* and 10*e* illustrate the second ascending stroke during which the pushing cup 4 is ascended along the second combined slideway. Referring to FIG. 10 and the drawings of the cosmetic container and components thereof shown in the above-mentioned embodiments, in a state of FIG. 10*a*, the first lugs 31 (blocked in the view of FIG. 10*a*) of the material cup 3 are locked in the material cup lower locking positions 301, so the material cup 3 remains stationary; the second lugs 41 (blocked in the view of FIG. 10*a*) of the pushing cup 4 are locked in the pushing cup lower locking positions 401, so the pushing cup 4 remains stationary; the material body 5 is hidden in the rotating member 2 (the threaded sleeve outside the rotating member 2 is not shown in FIG. 10), and the cosmetic container is in the idle state. Now, rotate the rotating member 2 in the positive direction, for example in a clockwise direction, guided by the first guide groove 11 and the second guide groove 12, the first lugs 31 of the material cup 3 and the second lugs 41 of the pushing cup 4 are respectively pushed into the first slideways 21, entering into a state shown in FIG. 10*b*. Continue to rotate the rotating member 2 in the positive direction, guided by the first guide groove 11 and the second guide groove 12, the first lugs 31 of the material cup 3 and the second lugs 41 of the pushing cup 4 will be ascended simultaneously along the first slideway 21 and push the second part 52 of the material body 5 out for use, until reaching a state shown in FIG. 10*c*. In FIG. 10*c*, the first lugs 31 of the material cup 3 have been ascended to a top of the first slideway 21. Continue to rotate the rotating member 2 in the positive direction, the first lugs 31 will be pushed into the material cup upper locking positions 302 by the first guide groove 11. During the process that the first lugs 31 are pushed into the material cup upper locking positions 302 by the first guide groove 11, due to the function of the third slideway that keep the pushing cup 4 and the material cup 3 rotating in the same direction (meanwhile the embedded ribs 33 and grooves 42 also play the limiting role), the second lugs 41 of the pushing cup 4 are pushed into the connected area 4012 between the second slideway 22 and the first slideway 21 by the second guide groove 12, entering into a state shown in FIG. 10*d*. Continue to rotate the rotating member 2, since the first lugs 31 are locked in the material cup upper locking positions 302, the material cup 3 will remain stationary; and under the guidance of the second guide groove 12 acted on the second lugs 41, the pushing cup 4 continues to ascend along the second slideway 22, pushes the first part 51 of the material body 5 placed in the material cup 3 out for use. As shown in FIG. 10*e*, the pushing cup 4 is ascended until the second lugs 41 reach the top of the second slideway 22, at this point the first part 51 of the material body 5 is completely pushed out, thus, the material body 5 can be completely used up.

Figure 11:
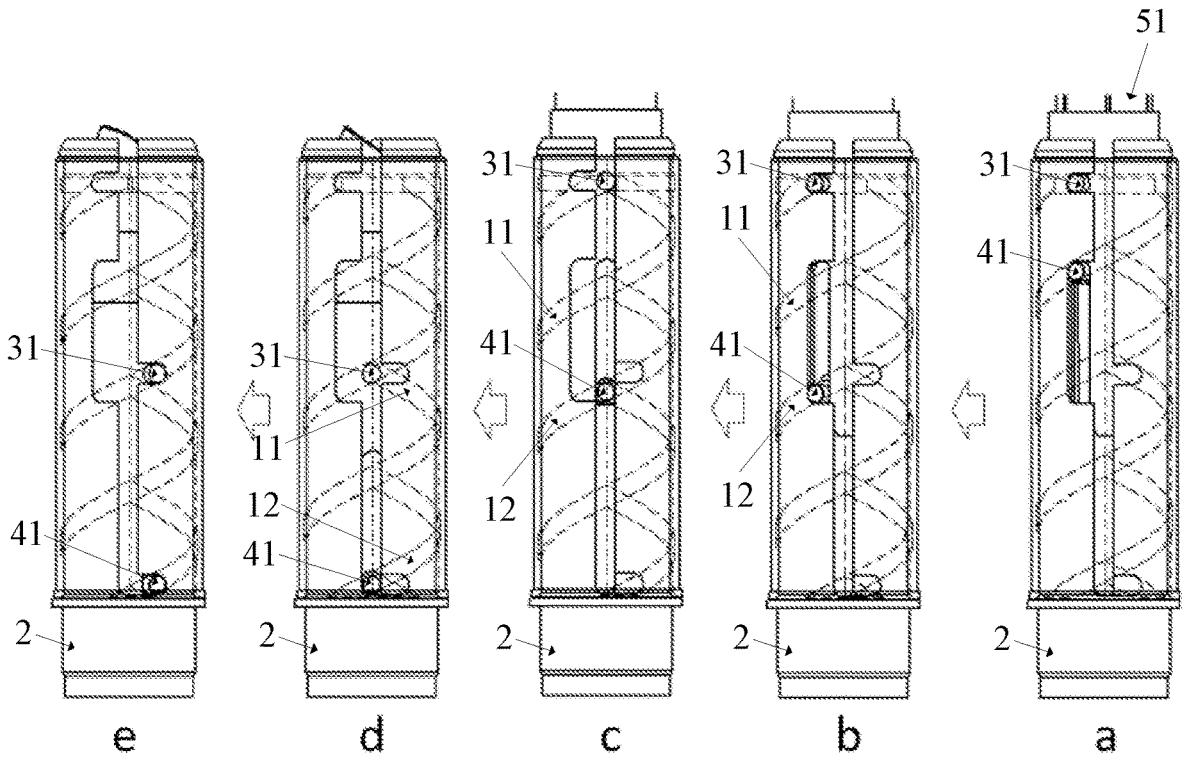
FIG. 11 is a schematic view of a negative rotation process of the cosmetic container in an embodiment of the present disclosure.

Referring to negative rotation processes of the cosmetic container shown in FIG. 11, wherein, FIGS. 11*a* and 11*b* illustrate the second descending stroke of the pushing cup descending along the second combined slideway, and FIGS. 11*b* to 11*e* illustrate the first descending stroke of the material cup and the pushing cup synchronously descending along the first combined slideway. Referring to FIG. 11 and the drawings of the cosmetic container and components thereof shown in the above-mentioned embodiments, in FIG. 11, when the material body 5 is used to the last part of the first part 51, the second lugs 41 of the pushing cup 4 are ascended to the top of the second slideway 22, and the first lugs 31 of the material cup 3 are locked in the material cup upper locking positions 302. Now, rotate the rotating member 2 in the negative direction, for example in an anticlockwise direction, under the guidance of the second guide groove 12, the second lugs 41 of the pushing cup 4 slide down along the second slideway 22, and the pushing cup 4 is descended, entering into a state shown in FIG. 11*b*. Continue to rotate the rotating member 2 in the negative direction, guided by the first guide groove 11 and the second guide groove 12, the first lugs 31 of the material cup 3 and the second lugs 41 of the pushing cup 4 are respectively pushed into the first slideway 21, entering into a state shown in FIG. 11*c*. Continue to rotate the rotating member 2 in the negative direction, guided by the first guide groove 11 and the second guide groove 12, the first lugs 31 of the material cup 3 and the second lugs 41 of the pushing cup 4 will be descended synchronously along the first slideway 21, entering into a state shown in FIG. 11*d*. Then continue to rotate the rotating member 2 in the negative direction, the first lugs 31 and the second lugs 41 will be pushed to the material cup lower locking positions 301 and the pushing cup lower locking positions 401, respectively, making the material cup 3 and the pushing cup 4 enter a locked state, respectively, as shown in FIG. 11*e*. During the locking process of the material cup 3 and the pushing cup 4, the first convex ribs 23 of the rotating member 2 and the second convex ribs of the material cup 3 will limit positions of the material cup 3 and the pushing cup 4, respectively.

During actual use processes of the cosmetic container, the second part 52 of the material body 5 exposed out of the material cup 3 is usually used firstly, after the second part 52 is used up, the first part 51 of the material body 5 placed in the material cup 3 will then be used. During the use process of the second part 52 of the material body 5, the first ascending stroke shown in FIGS. 10*a* to 10*d* and the first descending stroke shown in FIGS. 11*a* and 11*b* are alternately performed; and during the use process of the first part 51 of the material body 5, the ascending processes shown in FIG. 10 and the descending processes shown in FIG. 11 are alternately performed.

In addition, during production processes of the cosmetic container, firstly assemble the threaded sleeve 1, the rotating member 2, the material cup 3, the pushing cup 4 and other components, then rotate the rotating member 2, make the material cup 3 and the pushing cup 4 enter into the state shown in FIG. 10*d* or 11*b*, and then insert the material body 5 in the material cup 3 to the pushing cup 4 supporting the material body 5. During the process of inserting the material body 5, the first lugs 31 and the second lugs 41 can be stabilized by holding the threaded sleeve 1, so as to prevent the material cup 3 and the pushing cup 4 from loosening by force.

In conclusion, due to the rotatable material cup 3 and the pushing cup 4, the cosmetic container of the present disclosure has at least two strokes. During the first stroke, the material cup 3 and the pushing cup 4 can be ascended and descended synchronously, and during the second stroke, the pushing cup 4 can be ascended and descended relative to the material cup 3, realizing that the material body 5 contained in the material cup 3 is completely used up, which improves the utilization rate of the material body 5, and the material body 5 can be made of soft materials flexibly according to needs, thereby improving the user experience. For the rotating member 2 that provides a sliding space for the material cup 3 and the pushing cup 4, since the material cup 3 and the pushing cup 4 share the slideway pattern 20, the area of the slideway pattern 20 can be reduced to ensure the firmness of the rotating member 2. Furthermore, with the third slideway 32 extending axially, on the one hand, the material cup 3 and the pushing cup 4 can be moved in the same direction, and on the other hand, the third slideway 32 can be respectively overlapped with the first slideway 21 and the second slideway of the slideway pattern 20, forming the first combined slideway for the material cup 3 and the pushing cup 4 to ascend and descend synchronously and the second combined slideway only for the pushing cup 4 to ascend and descend, which increases flexibility of the rotation of the material cup 3 and the pushing cup 4.

The above is a further detailed description of the present disclosure with reference to the specific preferred embodiments, and it cannot be considered that the specific implementation of the present disclosure is limited to these descriptions. For those of ordinary skill in the art of the present disclosure, several simple deductions or substitutions can be made without departing from the concept of the present disclosure, which should be regarded as falling within the scope of protection of the present disclosure.

What is claimed is:

1. A cosmetic container, comprising:

a threaded sleeve, wherein an inner wall of the threaded sleeve is provided with a first guide groove and a second guide groove forming a double helix;

a rotating member, rotatably sleeved in the threaded sleeve, wherein a side wall of the rotating member is provided with a hollowed-out slideway pattern, and the slideway pattern comprises at least a first slideway and a second slideway parallel with each other, the first slideway and the second slideway both extend axially and are connected with each other;

a material cup, slidably sleeved in the rotating member, wherein a side wall of the material cup protrudes outwardly to form at least one first lug, the first lug passes through the slideway pattern and is limited in the first guide groove, and the side wall of the material cup is provided with a third slideway extending axially; and a pushing cup, slidably sleeved in the material cup, wherein a side wall of the pushing cup protrudes outwardly to form at least one second lug, the second lug passes successively through the third slideway and the slideway pattern and is limited in the second guide groove;

wherein when the rotating member is rotated relative to the threaded sleeve, the third slideway is successively overlapped with the first slideway and the second slideway, forming a first combined slideway for the pushing cup and the material cup to ascend and descend synchronously and a second combined slideway only for the pushing cup to ascend and descend;

wherein the first lug and the third slideway are arranged in a same axis; the first combined slideway comprises: the third slideway and a part of the first slideway that are overlapped with each other for the pushing cup to ascend and descend, and another part of the first slideway for the material cup to ascend and descend; the second combined slideway comprises the third slideway and the second slideway that are overlapped with each other;

wherein top of the first slideway is provided with a material cup upper locking position for preventing the material cup from ascending, and the material cup upper locking position is over the second slideway.

2. The cosmetic container according to claim 1, wherein the first slideway is provided with a material cup lower locking position for preventing the material cup from descending and a pushing cup lower locking position for preventing the pushing cup from descending.

3. The cosmetic container according to claim 1, wherein the rotating member comprises a cylinder part sleeved in the threaded sleeve and an actuating part extending out of the threaded sleeve, and the slideway pattern is hollowed out on a side wall of the cylinder part; wherein an end surface of the cylinder part connected with the actuating part is provided with first convex ribs for preventing the material cup from descending.

4. The cosmetic container according to claim 3, wherein a lower end surface of the material cup is provided with second convex ribs for preventing the pushing cup from descending.

5. The cosmetic container according to claim 1, wherein an inner wall of the material cup is provided with ribs extending axially, an outer wall of the pushing cup is provided with grooves extending axially, and the ribs are axially slidably limited in the grooves.

6. A method for using a cosmetic container, based on the cosmetic container according to claim 1, wherein the method comprises a first stroke of driving the material cup and the pushing cup to ascend and descend synchronously and a second stroke of only driving the pushing cup to ascend and descend;

the first stroke comprises a first ascending stroke and a first descending stroke, the second stroke comprises a second ascending stroke and a second descending stroke, the first ascending stroke and the second ascending stroke are performed sequentially, and the second descending stroke and the first descending stroke are performed sequentially;

wherein the first ascending stroke comprises: rotating the rotating member in a positive direction to drive the material cup and the pushing cup to ascend synchronously along the first combined slideway, until the first lugs of the material cup being pushed into the material cup upper locking positions and the second lugs of the pushing cup being pushed into the second slideway;

wherein the second ascending stroke comprises: rotating the rotating member in the positive direction to drive the pushing cup to ascend along the second combined slideway;

wherein the second descending stroke comprises: rotating the rotating member in a negative direction to drive the pushing cup to descend along the second combined slideway, until the second lugs of the pushing cup being pushed into the first slideway and the first lugs of the material cup being pushed into the first slideway from the material cup upper locking positions;

wherein the first descending stroke comprises: rotating the rotating member in the negative direction to drive the material cup and the pushing cup to descend synchronously along the first combined slideway.

* * * * *